US005906068A

United States Patent [19]

Bode

[11] Patent Number: 5,906,068

[45] Date of Patent: May 25, 1999

[54] ADJUSTABLE CHILD SAFETY GATE

[76] Inventor: Gerd Bode, 3617 W. Lincoln Ave., Sacramento, Calif. 95818

[21] Appl. No.: 08/777,923

[22] Filed: Dec. 23, 1996

[51] Int. Cl.[6] ..... E06B 7/00

[52] U.S. Cl. ..... 49/55; 49/465

[58] Field of Search ..... 49/55, 50, 57, 49/465, 463; 160/222, 225

[56] References Cited

U.S. PATENT DOCUMENTS

| | | | |
|---|---|---|---|
| D. 341,207 | 11/1993 | Freese et al. . | |
| D. 355,261 | 2/1995 | Abrams et al. . | |
| 4,492,263 | 1/1985 | Gebhard . | |
| 4,669,521 | 6/1987 | Barnes et al. . | |
| 4,723,587 | 2/1988 | Scruggs, Jr. . | |
| 4,787,174 | 11/1988 | Brown . | |
| 4,831,777 | 5/1989 | Johnson, Jr. . | |
| 4,884,614 | 12/1989 | Spurling . | |
| 4,944,117 | 7/1990 | Gebhard et al. | 49/55 |
| 4,984,619 | 1/1991 | Ellis . | |
| 5,060,421 | 10/1991 | Castelli . | |
| 5,199,753 | 4/1993 | Presley, Jr. . | |
| 5,272,840 | 12/1993 | Knoedler et al. . | |
| 5,360,191 | 11/1994 | Carson et al. . | |
| 5,367,829 | 11/1994 | Crossley et al. . | |
| 5,528,859 | 6/1996 | Taylor et al. | 49/55 |

*Primary Examiner*—Jerry Redman

*Attorney, Agent, or Firm*—Townsend and Townsend and Crew LLP

[57] ABSTRACT

A safety gate for restricting passage of a child through an access way such as a doorway or stairwell. The gate has two barrier panels in a parallel, overlapping arrangement that can be relatively adjusted to different combined widths to fit in different access ways. The gate is mounted on one side by contact pads or hinges, and can also be mounted pivotally on a telescoping pole vertically disposed on one side of the access way. The gate is frictionally secured or closed by extendable and retractable engagement feet adapted to forcibly engage the access way side wall. The engagement feet are controlled by an outwardly motivating extension mechanism connected via a reciprocating linkage with the engagement feet, which provides for reflexive engagement of both feet with approximately equal force, even in access ways having vertically uneven widths.

17 Claims, 8 Drawing Sheets

ADJUSTABLE CHILD SAFETY GATE

BACKGROUND OF THE INVENTION

The present invention relates to security gates to restrict movements of infants and small children through access ways, such as doorways and hallways leading to restricted areas of the home, stairways, or the like.

Child security gates must function as an impassible barrier to exclude passage of an infant or child through the accessway, but it is also necessary to provide for removal of the barrier to permit passage by an attending adult. Accordingly, a number of gate designs have been developed that allow for barrier removal, for example by collapsing the gate, pivoting the gate out of the access way, or removing the gate entirely from the access way.

In addition to providing a removable barrier that permits adult access, it is also desirable to provide a gate that is adaptable for installation in a variety of differently dimensioned access ways, and which may also be transferred from one access way to another to accommodate daily movements of the child and attending adult.

Various designs have been developed that address one or more of the above needs. For example, child safety gates have been designed that can be extended and retracted in a number of ways, to provide a removable barrier function and/or allow adjustable placement of the barrier to block differently dimensioned access ways. One conventional design provides a collapsible lattice gate that can be extended across an access way to provide a barrier or collapsed to allow adult passage. Examples of this type of gate are described in U.S. Pat. No. 4,723,587, issued to Scruggs, Jr. on Feb. 9, 1988, and in U.S. Pat. No. 4,669,521 issued to Barnes et al. on Jun. 2, 1991.

Another type of gate forms a barrier consisting of two or more partitions that slide relative to one another along tracks, slots or horizontally disposed rods. These gates can be expanded to occupy the entire width of the access way, or retracted to permit adult passage (either by collapsing, pivoting or removing the gate from the access way). One example of this general design is described in U.S. Pat. No. 4,831,777 issued to Johnson, Jr. on May 23, 1989.

Most sliding panel gates are installed and disengaged using a friction mounting mechanism, which typically incorporates spring biased telescoping rods or pistons with engagement feet that exert outward pressure to frictionally engage one or both sides of the access way. Such friction mounted barriers are removed by compressing the biasing spring to retract the rods or pistons, either manually or through a lever mechanism. Examples of safety gates employing various aspects of these design features are disclosed for example in U.S. Pat. No. 5,272,840 issued to Knoedler et al., on Dec. 28, 1993; 360,191; U.S. Pat. No. 4,492,263 issued to Gebhard; and U.S. Pat. No. 5,367,829 issued to Abrams et al. on Nov. 29, 1994.

While the above described safety gates are generally satisfactory for preventing passage of infants or small children through access ways, a number of shortcomings of such devices have been identified by the inventor. For example, although friction mounted gates permit rapid installation and removal, and avoid undesirable installation of mounting hardware in the access way, these gates are generally less stable than permanently installed gates (i.e. collapsible or pivoting gates mounted by fixed hinges, mounts and/or latches). More specifically, because these gates rely on friction mounting to secure the gate between the sides of the access way, a child may purposefully or accidentally apply sufficient force to knock the engagement feet loose, causing the gate to fall out of place. This problem may be exacerbated with conventional, spring biased mounting designs after long periods of use if biasing springs become fatigued and incapable of exerting sufficient force on the sides of the access way to prevent undesired dislodgement.

At least one existing safety gate partially ameliorates the problem of unreliable friction mounting, as disclosed in U.S. Pat. No. 5,367,829 issued to Crossley et al. on Nov. 29, 1994. In this two-panel gate design, paired bumpers on each side of the gate are brought into close juxtaposition with opposing sides of the access way by sliding the panels to increase their combined width to approximately fill the access way. The bumpers on one side are then lockably extendable by a camming mechanism rather than a spring, so that the gate is secured in a tighter friction fit within the access way.

This latter design suffers its own disadvantages, however, particularly in terms of its potential instability when used in access ways that feature unequal widths between the sides of the access way at heights corresponding to the upper and lower bumper positions. For example, if the access way is narrower adjacent the lower bumper than adjacent the upper bumper, engagement of the lower bumper with the side of the access way will limit extension of the upper bumper so that it does not tightly engage the access way. Accordingly, when an infant or child pushes or falls against the gate, the gate may become dislodged and allow passage of the child to a restricted area.

In view of the above, there is a need in the art for a child safety gate that more conveniently and reliably excludes passage of infants and small children through restricted access ways.

SUMMARY OF THE INVENTION

It is therefore an object of the invention to provide a child safety gate that is easy to install without requiring permanent hardware, and which reliably excludes passage of infants and small children through restricted access ways.

It is an additional object of the invention to provide a child safety gate that can be quickly and easily removed or repositioned to allow adult passage.

It is a further object of the invention to achieve the above objects in a child safety gate that is adaptable for installation within a variety of differently dimensioned accessways, and which can be transferred from one access way to another to accommodate daily activity routines and movements of the child and attending adult.

It is yet another object of the invention to achieve the above objects in a child safety gate that is friction mounted for rapid installation and removal, but which provides more secure engagement over spring-biased mechanisms and can be securely mounted in access ways featuring vertically non-uniform widths between opposing sides.

The invention achieves these objects and other objects and advantages by providing a novel, friction mounted safety gate for adjustable installation in access ways of varying dimensions, and in access ways having vertically non-uniform widths. The safety gate features two panels arranged in generally parallel and substantially overlapping relation to one another. The two panels are slidably and lockably interconnected with one another so that their combined width can be adjusted to a selected engagement width approximately fully extending across a selected access way in which the gate is to be emplaced.

The security gate of the invention also includes a mounting mechanism attached to one of the barrier panels to secure the panel in a generally fixed lateral position relative to one side wall of the access way. The other panel has upper and lower engagement feet connected to it which can be extended outwardly from the panel toward the other side wall of the access way or, alternatively, retracted inwardly away from the access way side wall. The engagement feet are specifically adapted to engage the access way side wall when the barrier panels are adjusted to the selected engagement width and the engagement feet are extended, with sufficient force to prevent the gate from being purposefully or accidentally dislodged by a child.

The safety gate of the invention features a novel design for extending the engagement feet outwardly in a reflexive manner to achieve firm engagement of both feet, even when the gate is installed in access ways having vertically uneven widths. Specifically, the invention provides an engagement feet extension mechanism that outwardly extends the engagement feet through a reciprocating surface connection or linkage. By virtue of this reciprocating connection, inward force exerted against one of the engagement feet when it contacts the side wall of the access way is translated to outward force exerted on the other engagement foot, which causes both engagement feet to engage the side wall with approximately equal engaging force.

DESCRIPTION OF THE SPECIFIC EMBODIMENTS

Figure 1:
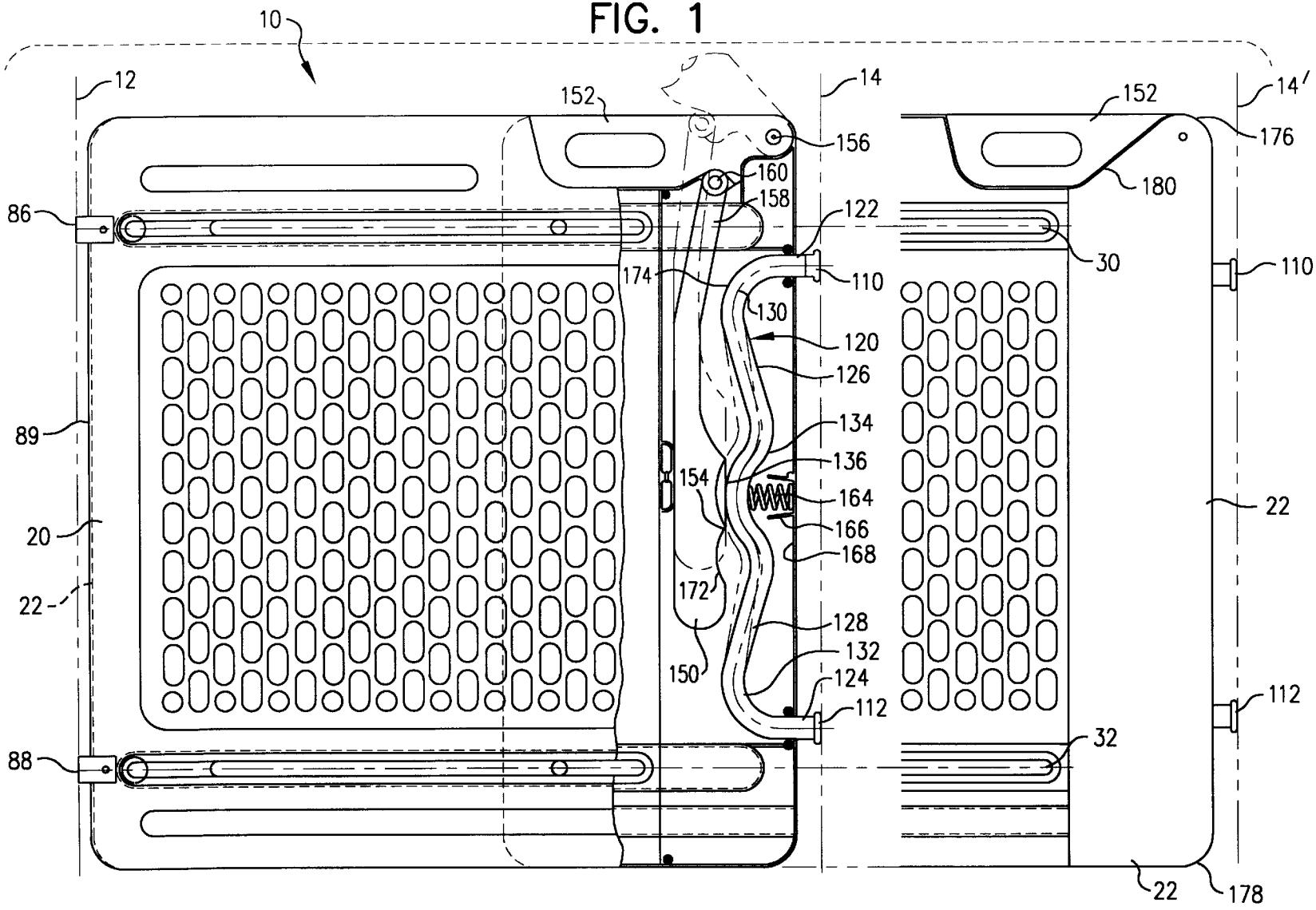
FIG. 1 is a partially cut away front elevation view showing a safety gate mounted in an access way and employing the concepts of the invention. The figure depicts two relative adjusted configurations of respectively sliding barrier panels of the gate, adjusted to fit either a narrow or wide access way (relative sliding positions of second barrier panel shown in phantom).
Figure 1A:
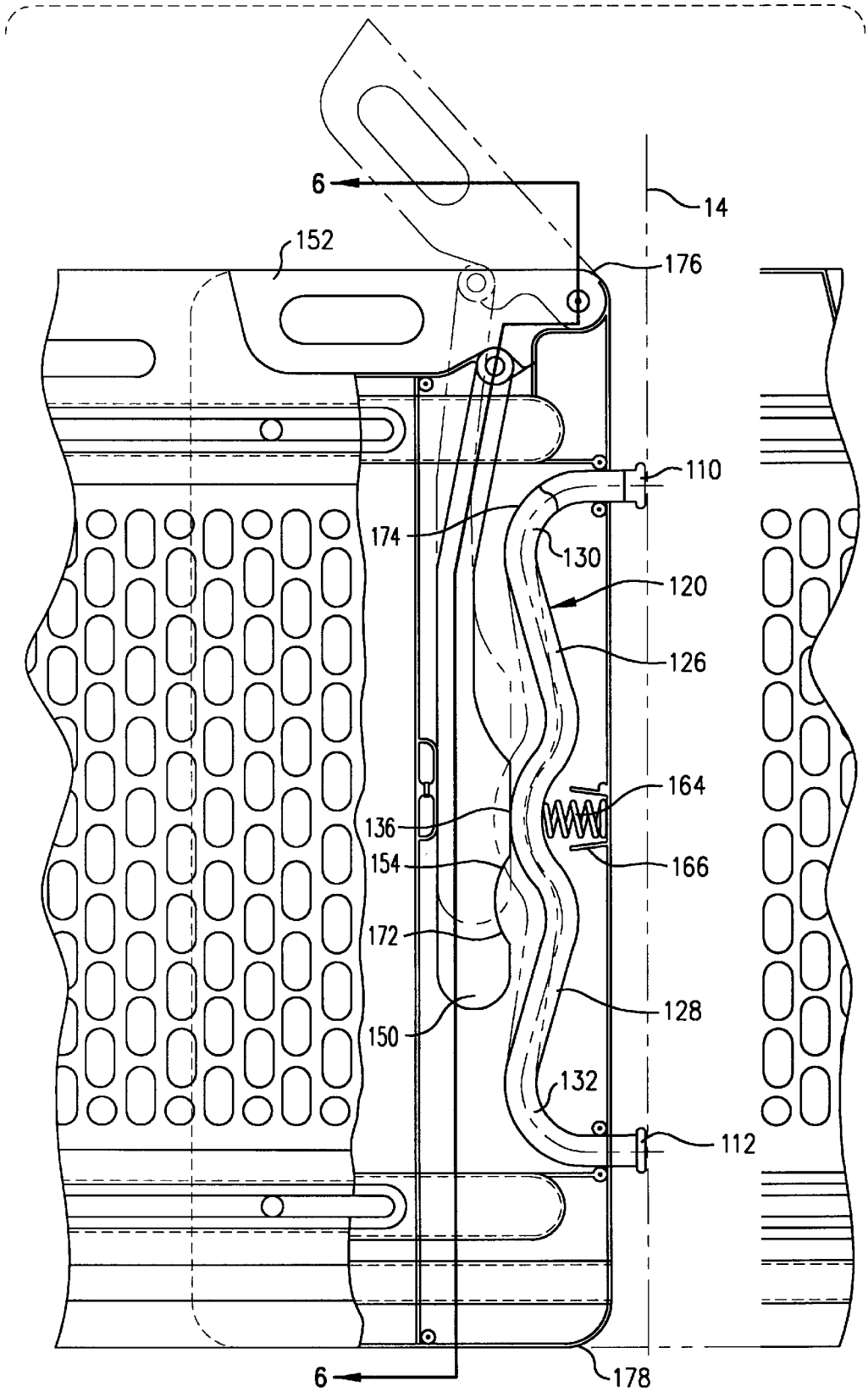
FIG. 1A is an enlarged view of a portion of FIG. 1 showing section orientation for FIG. 6.
Figure 2:
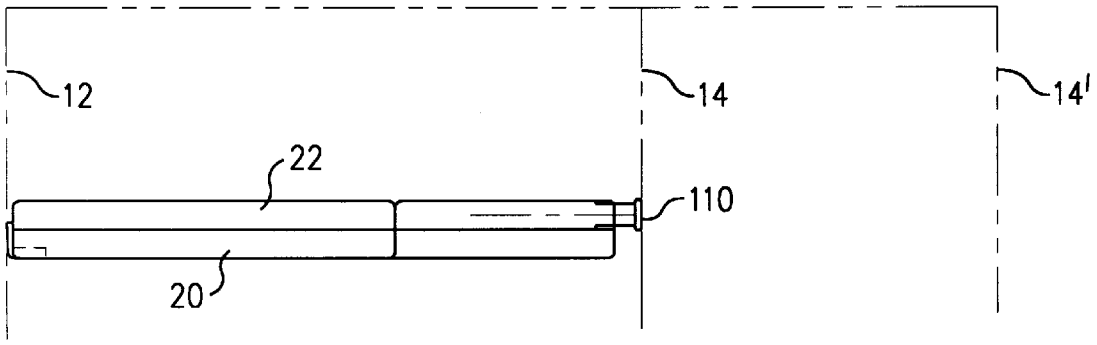
FIGS. 2 and 2A are top plan views of the safety gate of FIG. 1, depicting the relatively sliding barrier panels adjusted to a narrow, and wide, combined width configuration, respectively.
Figure 2A:
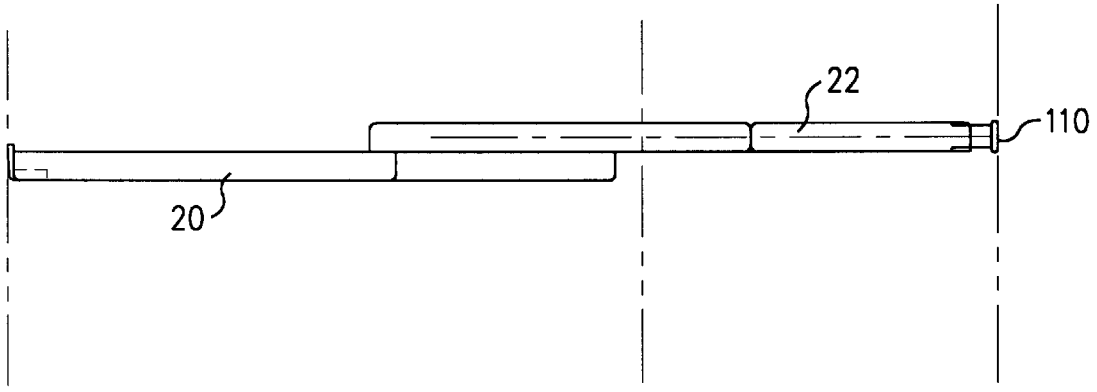

A child safety gate 10 employing the concepts of the invention is generally depicted in FIG. 1. The gate is adapted for removable installation within access ways defined by first and second access way side walls 12, 14 (for example opposing surfaces of door frames, pillars, hallway walls and stairwell sides).

To accommodate access ways of differing width dimensions (i.e. distances between the first and second side walls 12, 14), the safety gate includes a first barrier panel 20 (refer to FIGS. 1A–2A) and a second barrier panel 22 arranged in generally parallel and substantially overlapping relation to one another. The two panels can be constructed of a variety of materials, including woods, plastics or metals, with the principal requirement being that the panels must be suitably rigid to form a solid barrier to sustain pushing and other forces exerted by an infant or small child, and to prevent buckling of the panels under compression forces exerted by friction mounting of the gate within the access way.

Figure 4:
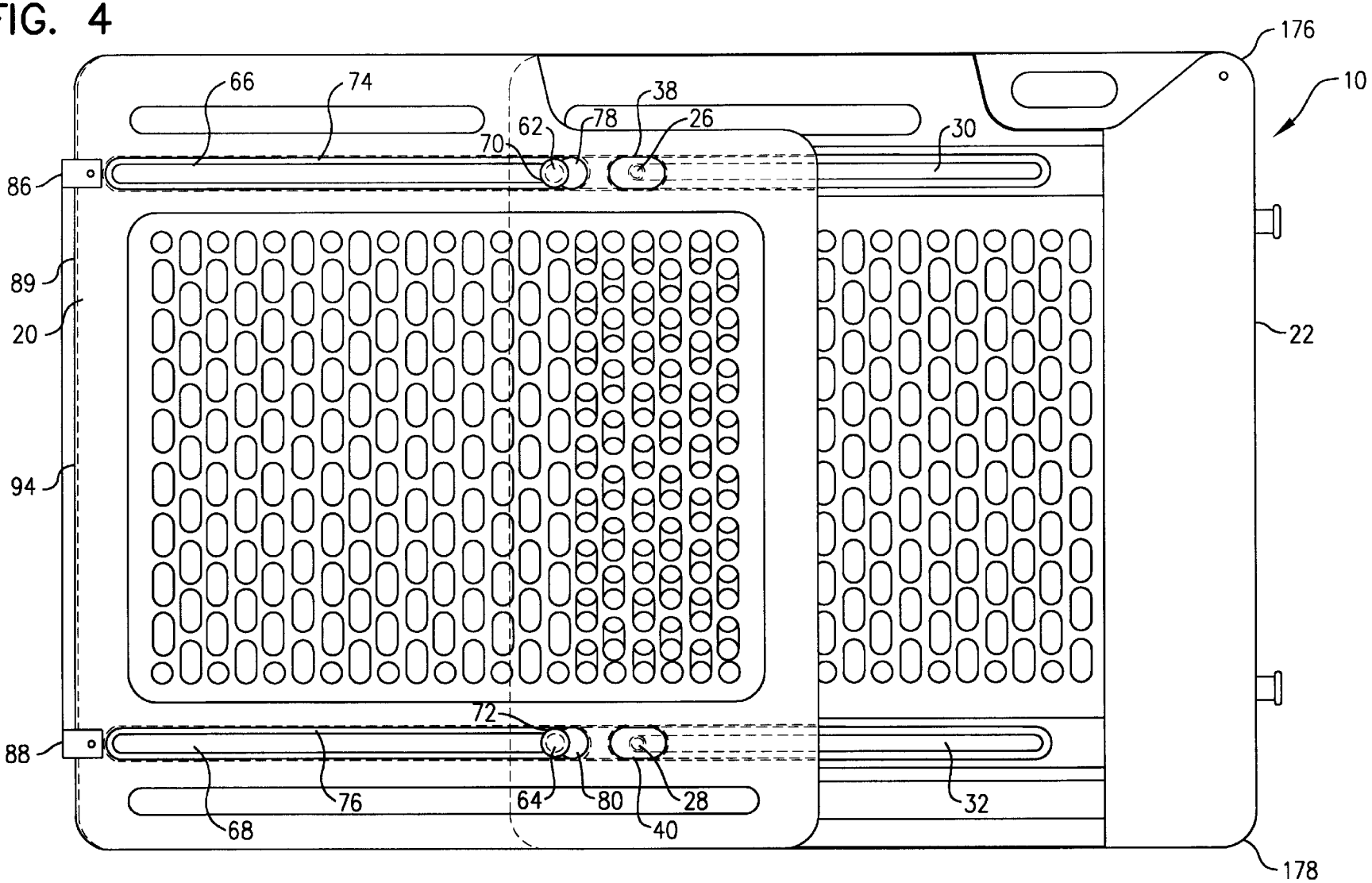
FIG. 4 is a front elevation view of the safety gate of FIG. 1 depicting the relatively sliding barrier panels adjusted to a wide combined width configuration.
Figure 7:
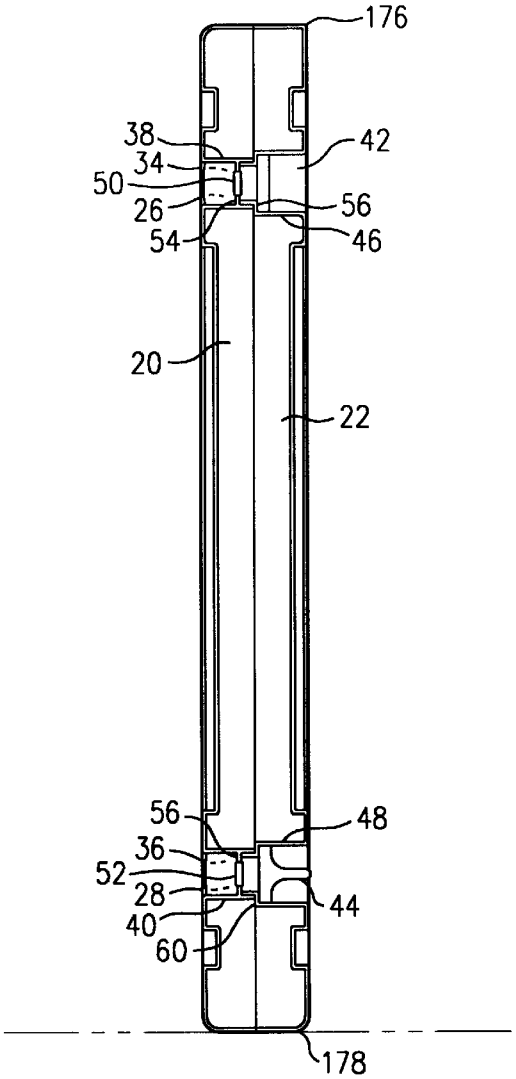
FIG. 7 is a cross sectional view of the safety gate of the invention taken along lines 7—7 of FIG. 3A.
Figure 6:
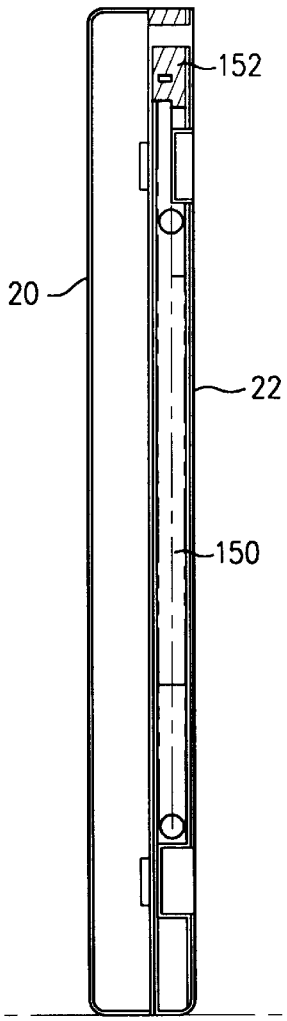
FIG. 6 is a cross sectional view of the safety gate of the invention taken along lines 6—6 of FIG. 1A.
Figure 5:
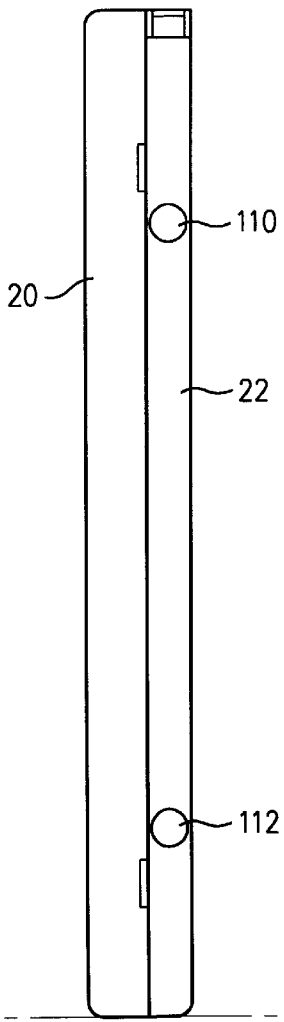
FIG. 5 is a right side elevation view of the safety gate of the invention depicting the relatively sliding barrier panels adjusted to a narrow combined width configuration.

Referring now to FIGS. 4 and 7, the first and second barrier panels 20, 22 are slidably, lockably interconnected with one another, preferably by threaded compression locking pins 26, 28 disposed within elongate, upper and lower second panel slots 30, 32 and threadedly engaged with upper and lower anchoring members 34, 36 matingly threaded with the pins and seated within upper and lower anchoring member seats 38, 40 formed in the first panel. The pins have flanged heads 42, 44 seated within upper and lower head channels 46, 48 surrounding the upper and lower second panel slots, which facilitate manual rotation of the pins to tighten or untighten the pins in cooperation with the corresponding anchoring members. The flanged heads of the pins have a greater diameter than a width dimension of the corresponding second panel slots, and the anchoring members likewise have a greater diameter than upper and lower pin apertures 50, 52 defined by upper and lower anchoring member seating surfaces 54, 56 of the anchoring member seats, to prevent the barrier panels from being pulled apart and to allow them to be compressibly interlocked.

Tightening of the pins 26, 28 compression seats the anchoring members 34, 36 forcefully against the upper and lower anchoring member seating surfaces 54, 56, and simultaneously seats the flanged heads 42, 44 against upper and lower head seating surfaces 58, 60, within the upper and lower head channels, thereby compressing the first barrier panel 20 and second barrier panel 22 against one another in a fixed relative position. Loosening of the pins releases the compression force frictionally interlocking the first and second barrier panels, and allows the panels to be slidably adjusted relative to one another, with the pins and head members freely sliding within the second panel, while the anchoring members remain positionally fixed relative to the first panel by their retention within the anchoring member seats.

Also interconnecting the first and second barrier panels 30, 32 are upper and lower slide pins 62, 64 (see FIG. 4) anchored to and extending from the second panel member 20 and spanning through upper and lower first panel slots 66, 68. The slide pins have terminal flanges 70, 72 that ride within upper and lower flange receiving channels 74, 76 in the first panel and have a flange diameter larger than a width dimension of the upper an lower first panel slots, thereby preventing the barrier panels from being pulled apart. To facilitate assembly of the gate, the first barrier panel also includes enlarged receptacles 78, 80 at the right ends of the first panel slots adapted to receive the terminal flanges of the slide pins for fitting the gates together and introducing the flanges into the flange receiving channels. Optionally, the slide pins can be replaced by a similar assembly of locking pins 26, 28 and anchoring members 34, 36 as described above, to provide for further security in compression interlocking the panels.

Other mechanisms for slidably, lockably interconnecting the first and second barrier panels 20, 22 are also provided within the scope of the invention. For example, the relative sliding functions of the above described system of slots, channels and pins can be optionally achieved by opposing rails (not shown) mounted to first and second barrier panels and slidably interconnected by wheel or bearing members. Likewise, alternate devices for interlocking the panels to affix their relative position, for example interlocking pins employing camming locks (not shown) instead of threaded pins, are also contemplated within the scope of the invention.

Figure 3:
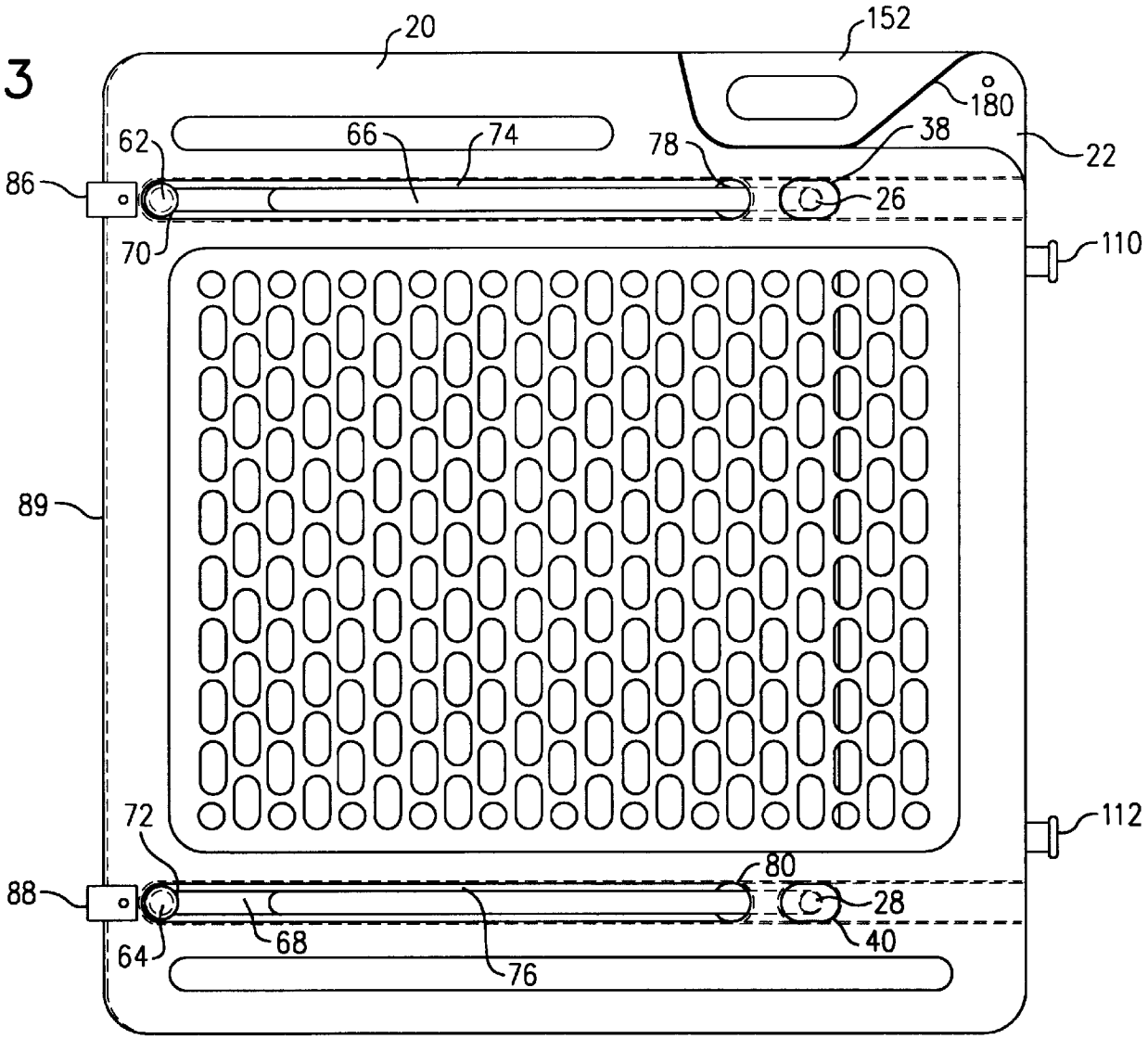
FIG. 3 is a front elevation view of the safety gate of FIG. 1 depicting the relatively sliding barrier panels adjusted to a narrow combined width configuration.
Figure 3A:
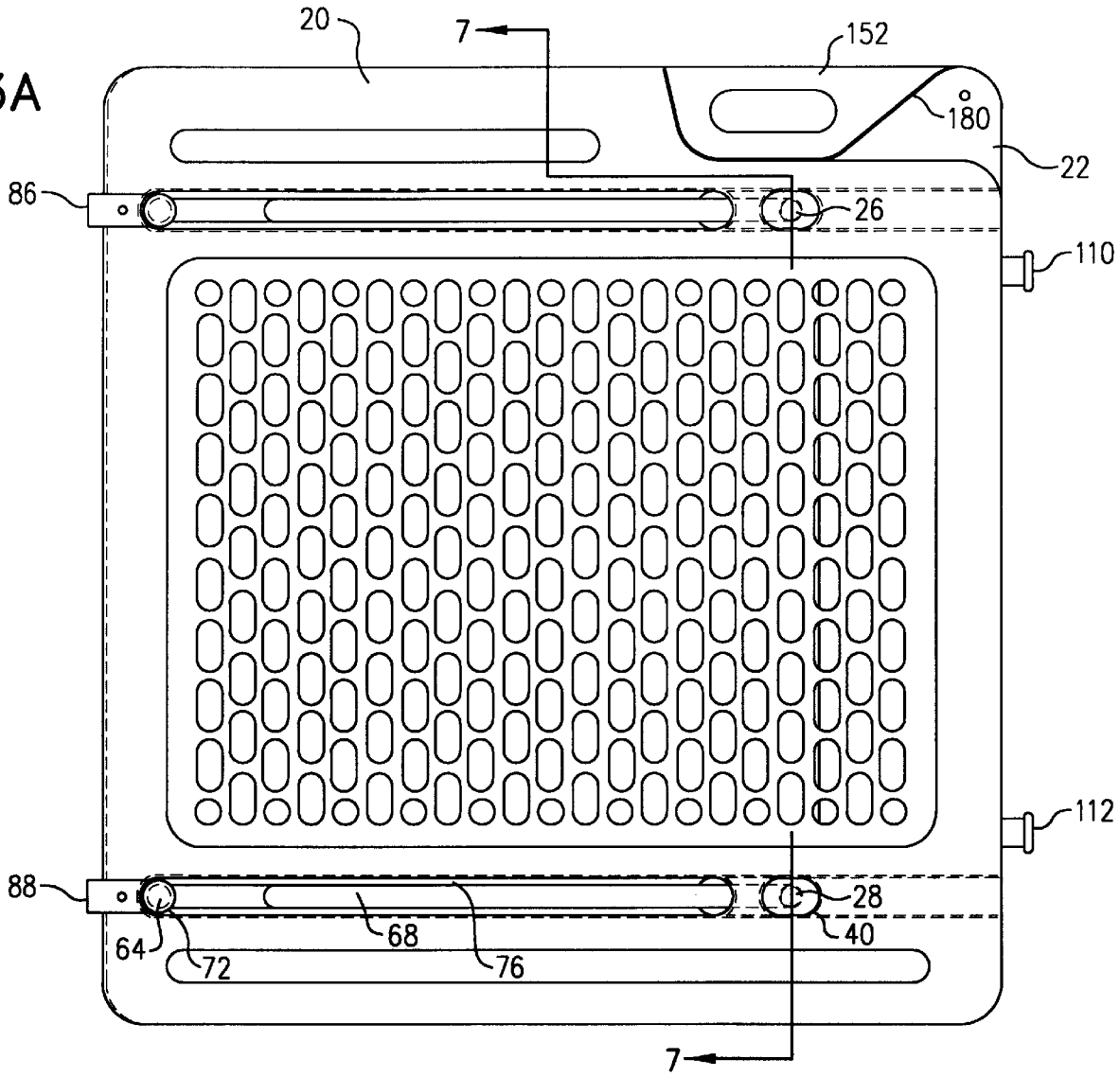
FIG. 3A is an enlarged view of FIG. 3 showing section orientation for FIG. 7.

The slidably interconnected relationship between the first and second barrier panels 20, 22 allows the safety gate 10 to be adjusted for installation within access ways of varying widths. More specifically, relative sliding adjustment between the first and second panels allows the gate to be adjusted to a minimum combined width of the two panels (as depicted in FIG. 3) of approximately 27 inches, and up to a maximum combined width of the two panels (as depicted in FIG. 4) of approximately 42 inches. This allows the gate to be adjusted to substantially fully span access ways varying in width within the approximate same range of 27–42 inches.

To further illustrate the adjustable width feature of the safety gate, FIG. 1 depicts two relative adjusted configurations of the barrier panels, adjusted to combined effective engagement widths that substantially span either a narrow access way (left side of Figure, with second access way side wall denoted by reference numeral 14) or a wide access way (right side of Figure, with second access way side wall denoted by reference numeral 14'). A similar adjustment series is depicted by comparing FIGS. 2 and 2A, and FIGS. 3 and 4. It will be noted that any combined effective engagement width between the above described minimum and maximum widths can be selected, and the only limitation for selecting alternate effective engagement widths for the gate is imposed by the size of the barrier panels and length of the first and second panel slots (66, 68 and 30, 32, respectively).

Prior to or concurrent with installing the security gate 10 within a selected access way, the first barrier panel 20 is mounted in a fixed lateral position relative to the first access way side wall 12. A variety of suitable mounting mechanisms are envisioned for this purpose, whereas a preferred mounting mechanism comprises upper and lower fixed bumpers 86, 88 carried on an first panel outer side rail 89 (see FIG. 1). The bumpers are preferably made of, or covered with, a resilient plastic or other polymeric material, more preferably rubber, that has limited compressibility and appropriate surface characteristics (such as ribs or protuberances) to non-yieldingly, frictionally engage an opposing surface. Therefore, by abutting the bumpers against the first access way side wall, the bumpers secure the panel in a generally fixed lateral position (i.e. from being pushed closer in a direct lateral movement) relative to the first side wall.

Figure 8:
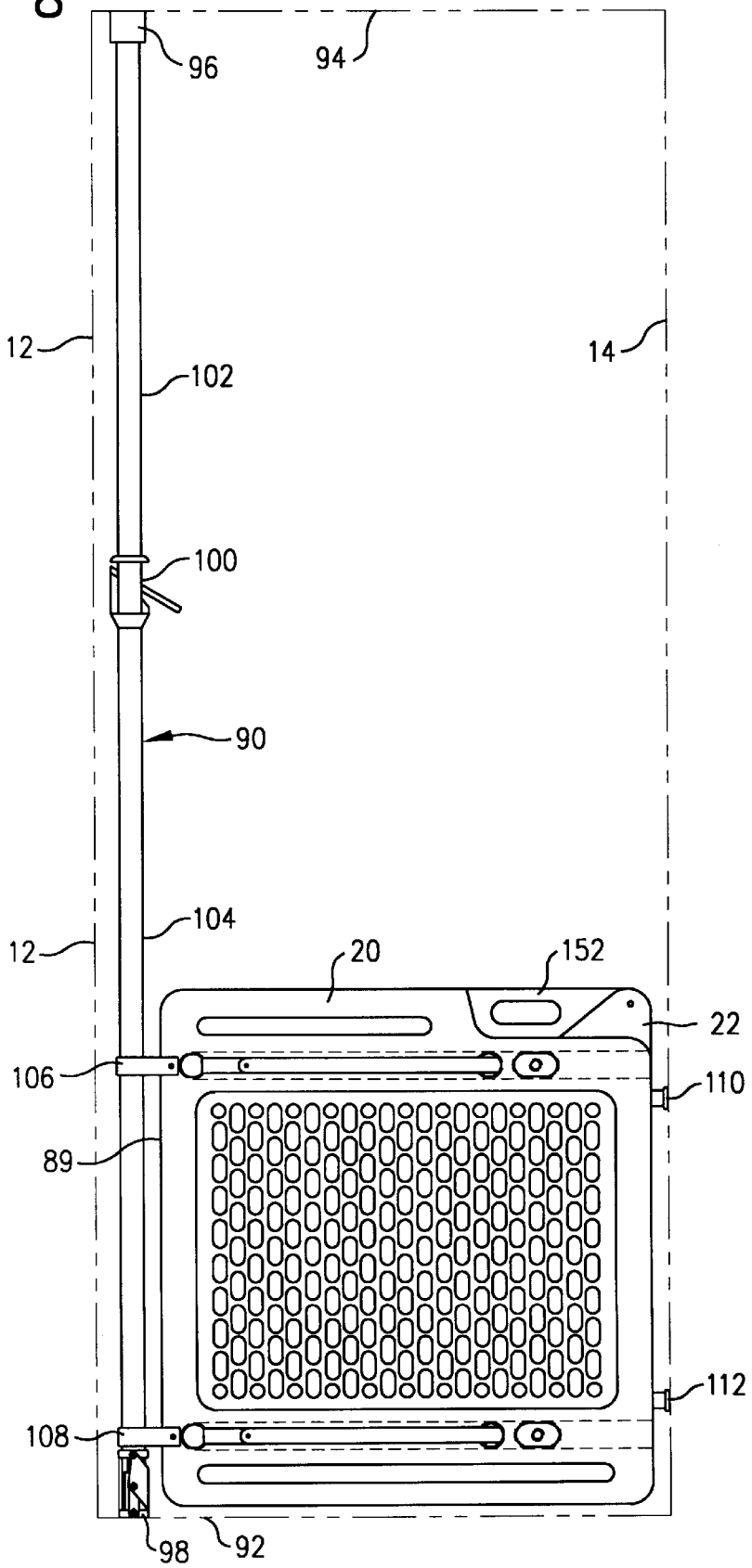
FIG. 8 is a front elevation view of a preferred embodiment of the safety gate of the invention employing a telescoping mounting pole and hinged mounting mechanism pivotally connecting the pole and safety gate.

Other mounting mechanisms to secure the first barrier panel 20 in a generally fixed lateral position relative to the first side wall 12 are also provided, including hinges (not shown) affixed directly to the side wall and pivotally interconnecting the first barrier panel 20 with the side wall. In a more detailed aspect of the invention (depicted in FIG. 8), pivotal mounting of the first barrier panel is achieved by hingedly connecting the first barrier panel to an adjustable, telescoping mounting pole 90 adjustably extensible between a floor surface 92 and ceiling surface 94 of a selected access way. The mounting pole has head and foot contact pads 96, 98 adapted to frictionally engage the ceiling and floor surfaces, respectively, and a lockable, adjustable telescoping control clamp 100 positioned between nested, upper and lower sections 102, 104 of the pole, which allows the length of the pole to be selectably adjusted to raise and lower the pole to fit different access ways. The pole is designed to have minimal flexure along its length, and is therefore preferably made of a rigid material such as fiber reinforced plastic. The pole is preferably installed closely adjacent the first side wall 12 of a selected access way by extending the pole until the head and foot pads contact the ceiling and floor surfaces with sufficient compression force to hold the pole firmly in position. The pole is preferably pivotally interconnected with the first barrier panel, preferably by upper and lower collar hinges 106, 108 that movably surround the pole and are fixedly connected to the first barrier panel outer side rail 89. By virtue of this mounting design, the gate can be opened and closed in a pivoting manner without necessitating installation of permanent hinges in the access way, thus preventing damage to access ways and allowing ready transfer of the gate and mounting assembly between different access ways. In addition, the novel pole mounting design described above is particularly useful to install the safety gate in access ways were one wall may have delicate surface ornamentation or paint, or where one wall surface may be irregular or otherwise unsuited for safe installation of a conventional safety gate.

To complete mounting or closure of the safety gate 10 within an access way, the second barrier panel 22 must also be secured relative to the second access way side wall 14. A preferred design for this purpose features upper and lower engagement feet 110, 112 connected to the second barrier panel which can be extended outwardly from the panel against the second access way side wall to mount or close the gate, or, alternatively, retracted inwardly away from the second access way side wall to remove or open the gate. The engagement feet are specifically adapted to engage the access way side wall when the barrier panels are adjusted to a selected engagement width and the engagement feet are extended. As used herein, a selected engagement width corresponds to a combined width of the first and second barrier panels 20, 22 (in an adjusted, locked relative position) that approximately fully spans a selected access way. More specifically, when the first barrier panel 20 is mounted in a fixed lateral position relative to the first access way side wall 12 (as described above for example by engagement of bumpers 86, 88 or emplacement of a mounting pole 90), the selected engagement width corresponds approximately to a combined width of the first and second barrier panels that brings the engagement feet 110, 112 in close juxtaposition to, and preferably just achieving non-forceful contact with, the second access way side wall when the engagement feet are in a fully retracted position. This selected width thus represents an effective engagement width whereby the engagement feet can be actuated from a retracted position to an extended position in which the engagement feet forcibly impinge against the second access way side to firmly secure the gate in position with sufficient force to prevent the gate from being purposefully or accidentally dislodged by a child.

Extension and retraction of the engagement feet 110, 112 is accomplished by a novel engagement feet extension mechanism that outwardly extends the engagement feet in a reflexive manner, to achieve firm engagement of both feet even when the gate is installed in access ways having vertically uneven widths. Specifically, the invention provides an engagement feet extension mechanism that outwardly extends the engagement feet through a reciprocating-like linkage design. In a preferred aspect of the invention, depicted in FIG. 1, this linkage design includes a generally bracket-shaped rocker element 120 interconnecting the upper and lower engagement feet 110, 112. The rocker element has straight, upper and lower terminal arm segments 122, 124 extending from the engagement feet and joined to upper and lower reflex arm segments 126, 128 by upper and lower, outwardly concave curvatures 130, 132 in the rocker element. The reflex arm segments of the rocker element are recurved and then converge at a central, outwardly concave curvature 134. On the inner, convex side of this curvature, the rocker element presents a curved rocker surface 136 which forms part of the reciprocating-like linkage for this embodiment.

It should be noted that the engagement feet need not be structurally separated from the terminal arm segments, and this term also applies to the very distal tips of the terminal arm segments if no separate pad structure is employed to cover the tips of the arm segments. Preferably, however, the engagement feet are structurally separate from the terminal arm segments and are comprised of a terminal pad or cover made of a resilient plastic or other polymeric material, more preferably rubber, that has limited compressibility and appropriate surface characteristics (such as ribs or protuberances) to non-yieldingly, frictionally engage an opposing surface.

Actuation of the rocker element 120 to drive extension of the engagement feet 110, 112 is achieved in the preferred embodiment of FIG. 1 by an elongate cam member 150 vertically disposed between opposing side walls of the second barrier panel 22 and operated by a pivoting handle 152 type lever mechanism. The cam member includes a camming surface 154 that immediately abuts the rocker surface 136 of the rocker element 120 when the cam member is raised. The cam member is raised and lowered by raising and lowering the handle 152, which is pivotally connected to the second barrier panel 22 at an anchor pivot 156, and to an upper cam arm 158 of the cam member 150 by a cam connector pivot 160.

When the handle 152 and cam member 150 are raised, the engagement feet 110, 112 are biased toward a retracted position by a biasing spring 164 seated within a spring housing 166 and disposed between a right inner surface 168 of the second barrier panel and the central curvature 134 of the rocker element 120. Retraction of the engagement feet is further accomplished by providing a curved nesting surface 172 contiguous with the camming surface 154 and shaped and dimensioned to nestingly receive the curved rocker surface 136 of the rocker element when the cam member is raised (as depicted in phantom in FIGS. 1 and 1A).

When the cam member 150 is forced downward by closure of the handle 152, the camming surface 154 is forcefully driven against the rocker surface 136 of the rocker element 120. Because the camming surface slopes outward in the direction of cam movement, engagement of the cam member against the rocker surface will ordinarily laterally displace the rocker element and thereby cause extension of the engagement feet. Extension of the engagement feet preferably involves outward movement of one or both of the engagement feet approximately ¼ to ¾ inches beyond their retracted position (note that the engagement feet when retracted may be flush with a second barrier panel outer side rail, i.e. retracted fully within the body of the second panel, or, alternatively, extend a minimal distance from the outer side rail to avoid retraction of an enlarged pad or cap into the body of the second panel). Greater extensibility is possible, however extension of the feet beyond about one inch would imply that too large a gap existed between the gate and side wall, which might impose danger to an infant or small child (e.g. by catching the child's wrist in the gap).

As described in more detail below, one of the engagement feet may be extended substantially farther than the other foot to provide secure installation in access ways having vertically uneven widths. Preferably, the difference in total extendibility between the two engagement feet ranges up to about one inch, and more preferably between about ¼ to ¾ inches.

If the engagement feet are already in sufficient forceful contact with the second access way side wall 14 when the cam member 150 is being operated, the rocker element 120 is designed to alleviate jamming of the cam member and allow full closure of the handle, by flexing between the rocker surface and the engagement feet. This flexing adaptability of the linkage design between the handle and engagement feet primarily involves inward flexing of the reflex arms 126, 128, which flexure is facilitated by construction of the rocker element from a semi-flexible material such as a aluminum, resilient plastic, fiberglass, graphite composite or other material with like flexibility characteristics. The extent of flexibility can be adjusted by changing the rocker element material, solidness, or cross sectional diameter. Preferably, a hollow aluminum tubing is used having an outer cross sectional diameter being approximately ½ to ¾ inch. This preferred construction and diameter of the rocker element allows for a desired extent of flexure between a top outer curvature surface 174 and the rocker surface 136 of the rocker element of about ¼ to ½ inch under a maximum stress exerted on the rocker element by the cam member operating through a full range of camming movement with the engagement feet of the rocker element in contact with a wall throughout the entire range of cam movement. It should be noted in this context that other devices to absorb overstress of components during engagement feet extension are also envisioned. For example, it is possible to emplace a spring biased seat (not shown) supporting the cam member on an opposite side of the cam member from the rocker element. More simply, the cam member can itself be made with a semi-flexible or yielding construction, for example out of hollow plastic.

As noted above, action of the cam member 150 outwardly extends the engagement feet in a reflexive manner, to achieve secure engagement of both feet even in unevenly dimensioned access ways. For example, many access ways are narrower in width closer to the floor surface 92 than higher up along the access way side walls 12, 14. In such cases the width of the access way will therefore be wider adjacent the upper engagement foot 110 than adjacent the lower engagement foot 112. Accordingly, because the extension feet are generally displaced an even distance from the second access way side wall when they are retracted, the lower engagement foot would ordinarily contact the unevenly spaced side wall before the upper engagement foot makes contact. To compensate for this uneven spacing and resultant unequal foot contact, the engagement feet extension mechanism incorporates a reciprocating-like linkage design, preferably a cam member 150 that exerts outward (lateral) force on a rocker element 120, coupled with a rocker surface 136 that can pivot relative to the cam member and thereby reflexively translate outward force to one or the other of the engagement feet in a generally reciprocating manner to achieve approximately equal force of engagement between both feet and the side wall. More specifically, if unequal foot contact occurs as in the example above, the lower engagement foot that first makes contact with the side wall exerts inward force on the corresponding terminal arm 124, which is translated under the driving influence of the cam member and pivoting action of the rocker to outward force exerted on the upper engagement foot 110, so that the upper foot more fully, or more forcefully, extends. As a result of this novel design, extension of each engagement foot is reflexive with respect to the degree of extension and force of engagement of the other engagement foot, whereby both engagement feet are extended to engage the side wall with approximately equal engaging force. This is achieved even in cases were one of the engagement feet must be extended substantially farther than the other foot to abut the opposing access way side wall. Preferably, the engagement feet are differentially extendable via this reflexive extension design up to a difference of about one inch, and preferably between about ¼ to ¾ inches. Thus, where width dimensions of a selected access way differ up to about one inch between upper and lower heights of the access way (corresponding to heights of the upper and lower extension feet) equal force engagement of the two extension feet can readily be achieved. In this context, it is noted that the upper and lower engagement feet are desirably spaced about 5–6 inches, and more preferably about 5¼ inches, from top and bottom edges 176, 178 of the second barrier panel (with the height of both barrier panels being about 27–29 inches). The upper and lower engagement feet are preferably spaced apart approximately 16–17 inches, more preferably about 16½ inches from their respective cross sectional midpoints.

As will be understood by those skilled in the art, a generally reciprocating linkage design for extending the engagement feet can be achieved by a variety of suitable alternative designs. One such design contemplated within the scope of the invention replaces the cam member 150 with a manually operable piston (not shown) having a piston arm directly, pivotally connected with the rocker element, thereby allowing for similar, reflexive translation of forces between the upper and lower engagement feet 110, 112 as described above.

Figure 9:
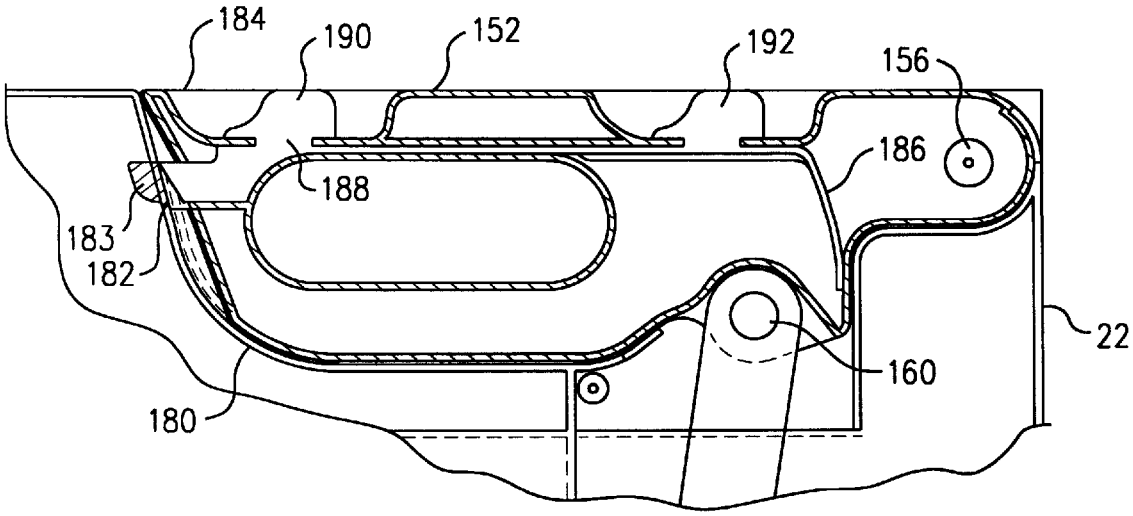
FIG. 9 is a partial, sectional view of a handle assembly of the invention employing an ambidextrous handle lock release mechanism.

In other preferred aspects of the invention (see FIG. 9) the handle 152 that operates the cam member 150 is recessed within a contoured seat 180 formed within the second barrier panel 22 and is lockable to prevent opening of the gate 10 by a child. The seat includes a slot 182 which receives a conventional detent 183 carried on a free end 184 of the handle. The detent is biased to engage the slot by a flex spring 186 and is disengaged manually by a single or dual, thumb operated slide 188. In the embodiment depicted in FIG. 9, a dual thumb slide is provided having upward extending flanges 190, 192 disposed on both the left and right sides of the handle, to allow ambidextrous operation of the gate to open the gate with equal ease in a simple, one-handed operation, regardless of the dexterity of the user or side of approach to the gate. This handle operation design is particularly useful in conjunction with pivotally mounted embodiments of the invention, such as the pole mounted configuration shown in the FIG. 8.

The safety gate 10 of the invention can be manufactured from a variety of suitably rigid materials, including woods, metals and plastics. For purposes of economy and ease of manufacture and assembly, a preferred material for manufacturing the safety gate, as well as many of its component parts and fittings, is a plastic. Plexiglass or lexan may be selected for the barrier panels 20, 22 to improve visibility through the gate for enhanced safety and psychological comfort for both the attending parent and child. For purposes of durability and precision, portions of the handle assembly and engagement feet extension mechanism may be preferably manufactured from a metal, high strength plastic or like material, as will be readily appreciated and routinely selected by persons of ordinary skill in the art.

Manufacturing of the safety gate and its component parts may also be achieved by a variety of alternatively suitable methods. Selection of preferred methods depends on the choice of materials, among other factors. Suitable manufacturing methods in this context include sheet metal or injection molding fabrication processes (e.g. for manufacture of barrier panels 20, 22 when a chosen material is metal, or plastic, respectively), casting, pressing, cutting and other like processes that will be readily appreciated and routinely applied by persons of ordinary skill in the art.

The foregoing description and examples are offered by way of illustration, not limitation. Therefore, the scope of the invention is not to be limited except by the claims which follow.

What is claimed is:

1. A safety gate for blocking passage through an access way defined by first and second vertical access way sides, comprising:

first and second barrier panels arranged in parallel, substantially overlapping relation, slidably interconnected with one another so that a combined width of the barrier panels can be lockably adjusted to a selected engagement width approximately fully spanning a selected access way;

mounting means connected to the first barrier panel to mount the first panel in a generally fixed lateral position relative to the first vertical access way side;

upper and lower engagement feet having a rocker element connected therebetween, and connected to the second barrier panel and outwardly extendable and inwardly retractable therefrom, both engagement feet adapted to forcibly engage the second access way side when the barrier panels are adjusted to the selected engagement width and the engagement feet are extended; and engagement feet extension means operable to outwardly extend the upper and lower engagement feet and having a reciprocating connection with the engagement feet so that inward force exerted against one of the engagement feet in contact with the second access way side is translated to outward force exerted on the other engagement foot, whereby both engagement feet can be extended to engage the second access way side with approximately equal engaging force.

2. A safety gate according to claim 1, wherein the engagement feet extension means includes a manually controlled cam member vertically disposed within the second barrier panel and having a camming surface adapted to engage and laterally displace a rocker surface interconnected between the upper and lower engagement feet.

3. A safety gate according to claim 1, wherein the mounting means includes a telescoping pole pivotally connected to the first barrier panel and extendable to an effective mounting height to firmly engage opposing ends of the pole against opposing floor and ceiling surfaces of the access way, whereby the gate can be freely pivoted about a longitudinal axis of the pole when the engagement feet are retracted.

4. A safety gate according to claim 3, wherein the pole is pivotally interconnected with the first barrier panel by upper and lower collar hinges that movably surround the pole and are fixedly connected to a first barrier panel outer side rail.

5. A safety gate according to claim 1, wherein the mounting means comprises upper and lower fixed bumpers carried on an outer side rail of the first panel member.

6. A safety gate according to claim 1, wherein the rocker element is generally bracket-shaped.

7. A safety gate according to claim 1, including the rocker element disposed between the upper and lower engagement feet and having a curved rocker surface.

8. A safety gate according to claim 1, including the rocker element having terminal arm segments, wherein the engagement feet are structurally separate from the terminal arm segments and are comprised of a cap or cover adapted to non-yieldingly, frictionally engage an opposing surface.

9. A safety gate according to claim 1, wherein the engagement feet extension means includes a camming surface that abuts the rocker element linking the upper and lower engagement feet together with one another, the rocker element pivotally disposed relative to the cam member so that the rocker element can reflexively translate outward force exerted by the cam member to one or the other of the engagement feet in a reciprocating manner to achieve approximately equal force of engagement between both engagement feet against the second access way side wall.

10. A safety gate according to claim 1, wherein the engagement feet are differentially extendable by the operation of a single engagement feet extension control.

11. A safety gate according to claim 10, wherein the engagement feet extension control is an ambidextrously released locking handle.

12. A safety gate according to claim 10, wherein a range of differential extendibility between the upper and lower engagement feet is up to ¾ inches.

13. A safety gate according to claim 1, wherein the engagement feet extension means includes the rocker element formed of a semi-flexible material.

14. A safety gate according to claim 13, wherein the semi-flexible material is aluminum, plastic, fiberglass or graphite composite.

15. A safety gate according to claim 1, wherein the rocker element has a range of flexure between a top outer curvature surface and a rocker surface of the rocker element of about ¼ to ½ inch under a maximum stress exerted on the rocker element between the engagement feet extension means and the access way second side wall.

16. A safety gate according to claim 1, wherein the upper and lower engagement feet are desirably spaced about 5–6 inches from top and bottom edges, respectively, of the second barrier panel.

17. A safety gate according to claim 1, wherein the upper and lower engagement feet are spaced apart approximately 16–17 inches measured between cross sectional midpoints of the engagement feet.

* * * * *